US008717856B2

(12) United States Patent
Lin et al.

(10) Patent No.: US 8,717,856 B2
(45) Date of Patent: May 6, 2014

(54) ELECTRONIC DEVICE AND METHOD FOR PROVIDING AND DISARMING ALARM CLOCK

(75) Inventors: Tay-Yang Lin, New Taipei (TW); Chin-Feng Chen, New Taipei (TW); Shu-Ming Liu, New Taipei (TW); Chi-Tse Shih, New Taipei (TW); Ni-Chun Hou, New Taipei (TW); Hsin-Chih Hsu, New Taipei (TW); Cheng-Hsiu Du, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 453 days.

(21) Appl. No.: 13/197,958

(22) Filed: Aug. 4, 2011

(65) Prior Publication Data

US 2012/0195175 A1 Aug. 2, 2012

(30) Foreign Application Priority Data

Jan. 28, 2011 (TW) ..... 100103507 A

(51) Int. Cl.
*G04C 21/00* (2006.01)

(52) U.S. Cl.
USPC ..... 368/250; 368/109

(58) Field of Classification Search
USPC ..... 368/244, 251, 256, 250, 243, 327, 109
See application file for complete search history.

(56) References Cited

U.S. PATENT DOCUMENTS

| | | | | |
|---|---|---|---|---|
| 4,430,006 | A | 2/1984 | Jetter | |
| 5,189,648 | A * | 2/1993 | Cooper et al. | 368/73 |
| 6,977,868 | B2 * | 12/2005 | Brewer et al. | 368/46 |
| 7,746,730 | B2 * | 6/2010 | Olayinka et al. | 368/28 |
| 7,907,476 | B2 * | 3/2011 | Lee | 368/10 |
| 7,990,807 | B2 * | 8/2011 | Li et al. | 368/73 |
| 8,284,631 | B2 * | 10/2012 | Cho et al. | 368/10 |
| 8,584,050 | B2 * | 11/2013 | Ording et al. | 715/864 |
| 2008/0084319 | A1 | 4/2008 | Fan | |
| 2008/0165149 | A1 | 7/2008 | Platzer et al. | |
| 2009/0059733 | A1 | 3/2009 | Li et al. | |
| 2010/0192105 | A1 | 7/2010 | Kim et al. | |

FOREIGN PATENT DOCUMENTS

| | | | |
|---|---|---|---|
| JP | 2002296376 A | | 10/2002 |
| WO | WO 97/35238 | * | 9/1997 |
| WO | WO 2006/111481 | * | 10/2006 |

* cited by examiner

*Primary Examiner* — Sean Kayes
(74) *Attorney, Agent, or Firm* — Novak Druce Connolly Bove + Quigg LLP

(57) ABSTRACT

An electronic device includes a touch-screen display, a processor, a memory, and one or more modules stored in the memory. The one or more modules are adapted to be executed by the processor to enter into a user-interface alarm state from a user-interface non-alarm state in responds to an alarm trigger condition. The one or more modules are adapted to display one or more contact areas on the touch-screen display in the user-interface alarm state. The one or more modules are adapted to change locations of the one or more contact areas on the touch-screen display. The one or more modules are adapted to detect one or more contact actions on each of the one or more contact areas on the touch-screen display. The one or more modules are adapted to change the electronic device to the user-interface non-alarm state.

18 Claims, 4 Drawing Sheets

ELECTRONIC DEVICE AND METHOD FOR PROVIDING AND DISARMING ALARM CLOCK

BACKGROUND

The disclosed embodiments relate generally to user interfaces, and more particularly, to an alarm clock on a portable electronic device.

DESCRIPTION OF RELATED ART

Electronic devices with touch-screens and applications running on such devices may have alarm clock function to awaken people from sleep or short naps or other reminders as well. The alarm clock of the electronic device may be designed to sound at a specific time. Alarm clock may be disarmed easily through pressing a button on the electronic device or may automatically disarm if left unattended long enough.

However, many alarm clock disarming methods are too easy to awaken people from a deep sleep. There is a room for improvement within the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

In general, the word "module", as used herein, refers to logic embodied in hardware or firmware, or to a collection of software instructions, written in a programming language, such as, Java, C, or assembly. One or more software instructions in the modules may be embedded in firmware, such as EPROM. The modules described herein may be implemented as either software and/or hardware modules and may be stored in any type of non-transitory computer-readable medium or other storage device. Some non-limiting examples of non-transitory computer-readable media include CDs, DVDs, BLU-RAY, flash memory, and hard disk drives.

Figure 1:
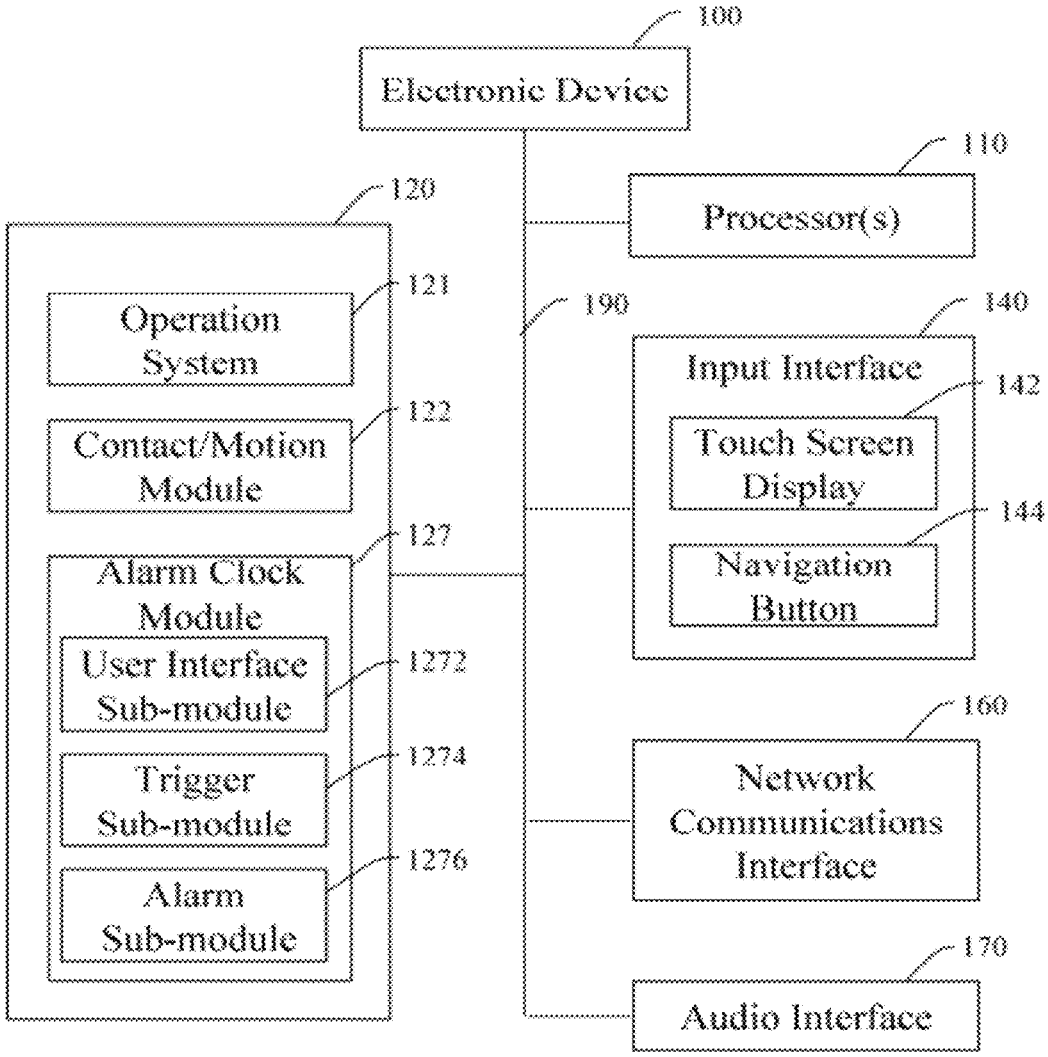
FIG. 1 is a block view of an electronic device in one embodiment.

FIG. 1 is a block diagram illustrating a multifunction electronic device 100 in accordance with more than one embodiment. The electronic device 100 may be a portable electronic device, such as a tablet computer. The electronic device 100 typically includes one or more processors 110, a memory 120, one or more input interfaces 140, one or more network communications interfaces 160, one or more audio interfaces 170, and one or more communication buses 190 for interconnecting these components.

It should be appreciated that the electronic device 100 is only one example of a multifunction device 100, and that the electronic device 100 may have more or fewer components than shown, it may combine two or more components, or it may have a different configuration or arrangement of the components. The various components shown in FIG. 1 may be implemented in hardware, software or a combination of both hardware and software, including one or more signal processors and/or application-specific integrated circuits.

The memory 120 includes high-speed random access memory, and may include non-volatile memory, such as one or more magnetic disk storage devices, optical disk storage devices, flash memory devices, or other non-volatile solid state storage devices. The memory 120 may optionally include one or more storage devices remotely located from the processors 110. All access to the memory 120 by other components of the electronic device 100, such as the processor 110, may be controlled by a memory controller. The one or more processors 110 may run or execute various software programs and/or sets of instructions stored in the memory 120 to perform various functions for the electronic device 100 and to process data.

The communication buses 190 may include circuitry that interconnects and controls communications between system components.

The input interfaces 140 may include a touch-screen display 142 and one or more navigation buttons 144. The touch-screen display 142 may be called a touch-sensitive display. The input interfaces 140 may also include other input devices such as a keyboard and/or mouse and/or other pointing devices.

The touch-screen display 142 provides an input interface and an output interface between the electronic device 100 and a user. The touch-screen display 142 includes a touch-sensitive surface that accepts input from the user based on physical contact and may display visual output to the user. The visual output may include graphics, text, icons, video, and any combination thereof. In some embodiments, some or all of the visual outputs may correspond to, or represent, user-interface objects. The touch-screen display 142 detects contact (and any motion or breaking of the contact) on the display 142 and converts the detected contact into an interaction with user-interface objects (e.g., one or more soft keys, icons, web pages or images) that are displayed on the touch-screen display 142. In one embodiment, a user may contact with a touch-screen display 142 with a finger.

The touch-screen display 142 may use liquid crystal display (LCD) technology, or a light emitting polymer display (LPD) technology, although other display technologies may be used in other embodiments. The touch-screen display 142 may detect contact and any motion or breakage thereof using any of a plurality of touch sensing technologies now known or later to be developed, including but not limited to capacitive, resistive, infrared, and surface acoustic wave technologies, as well as other proximity sensor arrays or other elements for determining one or more points of contact with a touch-screen display 142. The user may make contact with the touch-screen display 142 using any suitable object or appendage, such as a stylus or a finger. In some embodiments, the user interface is designed to work primarily with fingertip contact and motions, which are less precise than stylus-based input due to the larger area of surface contact of a finger on the touch-screen.

In some embodiments, the electronic device 100 may include a navigation button (or wheel) 144 as an input control device. The user may navigate among and interact with one or more graphical objects displayed on the touch-screen display 142 by rotating or clicking the navigation button 144 as required.

The network communication interface 160 may include wireless communication interface and wire communication interface. The wireless communication interface may use any of a plurality of communications standards, protocols and technologies, including but not limited to Global System for Mobile Communications (GSM), Enhanced Data GSM Environment (EDGE), wideband code division multiple access (W-CDMA), code division multiple access (CDMA), time division multiple access (TDMA), BLUETOOTH, Wireless Fidelity (Wi-Fi) (e.g., IEEE 802.11a, IEEE 802.11b, IEEE 802.11g and/or IEEE 802.11n), voice over Internet Protocol (VoIP), Wi-MAX, a protocol for email, instant messaging, and/or Short Message Service (SMS), or any other suitable communication protocol, including communication protocols not yet developed as of the filing date of this document.

The audio interface 170 is provided between a user and the electronic device 100, and may include audio circuitry, a speaker, and a microphone.

In some embodiments, the software components stored in the memory 120 may include an operating system 121, a contact/motion module (or set of instructions) 122, and an alarm clock module 127.

The operating system 121 (e.g., Darwin, RTXC, LINUX, UNIX, OS X, WINDOWS, or an embedded operating system such as VxWorks) includes various software components and/or drivers for controlling and managing general system tasks (e.g., memory management, storage device control, power management) and facilitates communication between various hardware and software components.

The contact/motion module 122 may detect contact with the touch-screen display 142. The contact/motion module 122 includes various software components for performing various operations as a result of the detection of contact, such as determining if there is motion of the contact and tracking the motion across the touch-screen display 142, and determining if the contact has been broken (i.e., if the contact has ceased). Determining any motion of the point of contact may include determining its speed (magnitude), velocity (magnitude and direction), and/or an acceleration (a change in magnitude and/or direction). These operations may be applied for single contacts (e.g., one finger contacts) or to multiple simultaneous contacts (e.g., "multi-touch"/multiple finger contacts).

The alarm clock module 127 may include a user interface sub-module 1272, a trigger sub-module 1274, and an alarm sub-module 1276.

Figure 2:
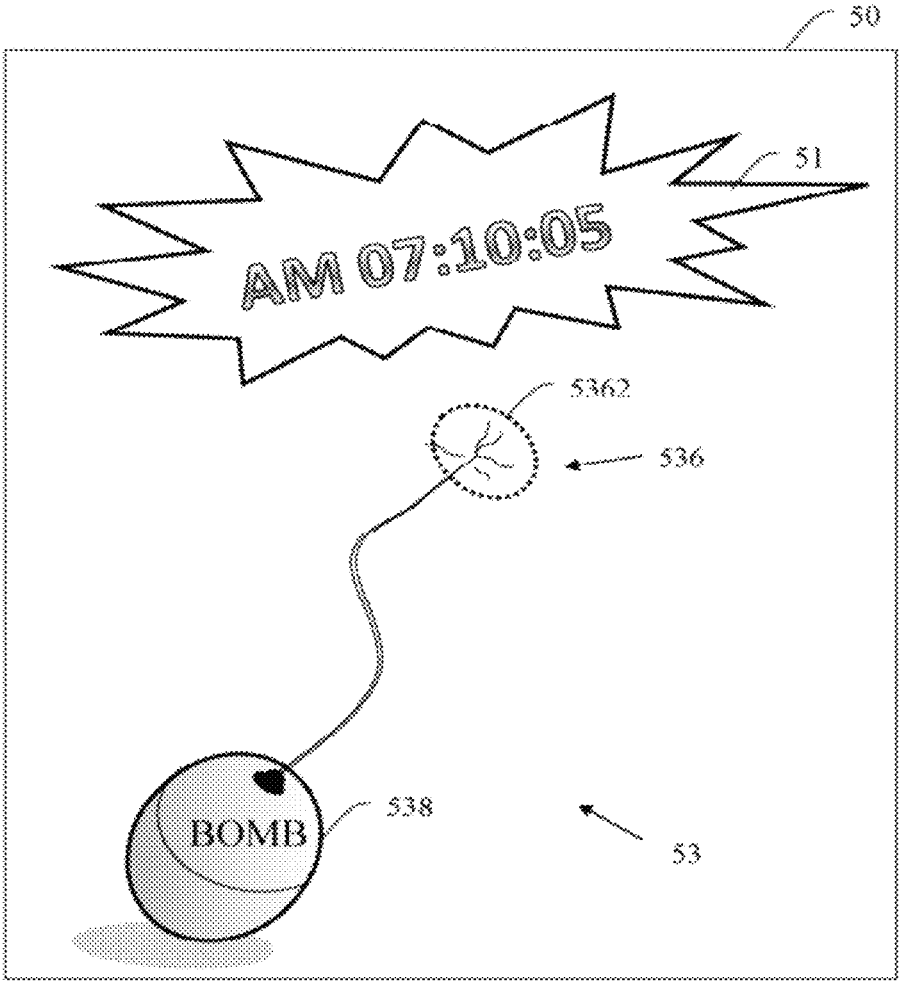
FIG. 2 is a user interface in a user-interface alarm state in one embodiment.

Referring to FIG. 2, the user interface sub-module 1272 controls a user-interface alarm state of the electronic device 100. The electronic device 100 may enter into the user-interface alarm state from a user-interface non-alarm state, such as a locking state, or a working state, in responds to an alarm trigger condition, for example, in response to the expiration of a predefined time. In the user-interface alarm state, a user interface 50 may be displayed on the touch-screen display 142. In one embodiment, a contact area 536, a first animation image 51 and a second animation image 53 may be displayed on the user interface 50. The first animation image 51 may display present time dynamically by flashing. The contact area 536 may be displayed with a trigger animation image 5362. The location of the contact area 536 may be changed on the touch-screen display 142 at a predefined frequency. The second animation image 53 may be associated with the trigger animation image 5362. For example, the second animation image 53 may present a bomb 538 with at least one firing detonating fuse, and the trigger animation image 5362 may be a firing point at the firing detonation fuse.

The trigger sub-module 1274 may detect one or more contact actions on the contact area 5362 on the touch-screen display 142, and terminal the user-interface alarm state of the electronic device 100 accordingly. The unlock module detects the satisfaction of any or all of one or more of the conditions applicable to disarming the alarm clock and restoring functionality to the electronic device 100.

The contact actions may include one or more press operations on the contact area 536. Each of the press operations on the contact area 536 may include one or more press operations or a predefined pressing duration. The contact actions include one or more substantially circled slide operations around each of the contact areas 536 while maintaining continuous contact with the touch-screen display 142.

The alarm sub-module 1276 may play an alarm audio file at the user-interface alarm state. The alarm sub-module 1276 may also control the volume of the playing alarm audio file. For example, the volume of the playing alarm audio file may be increased as time passed by. The alarm sub-module 1276 may execute a predefined operation, such as telephoning a predefined number, or vibrating the electronic device 100, after expiration of the alarm.

Figure 3:
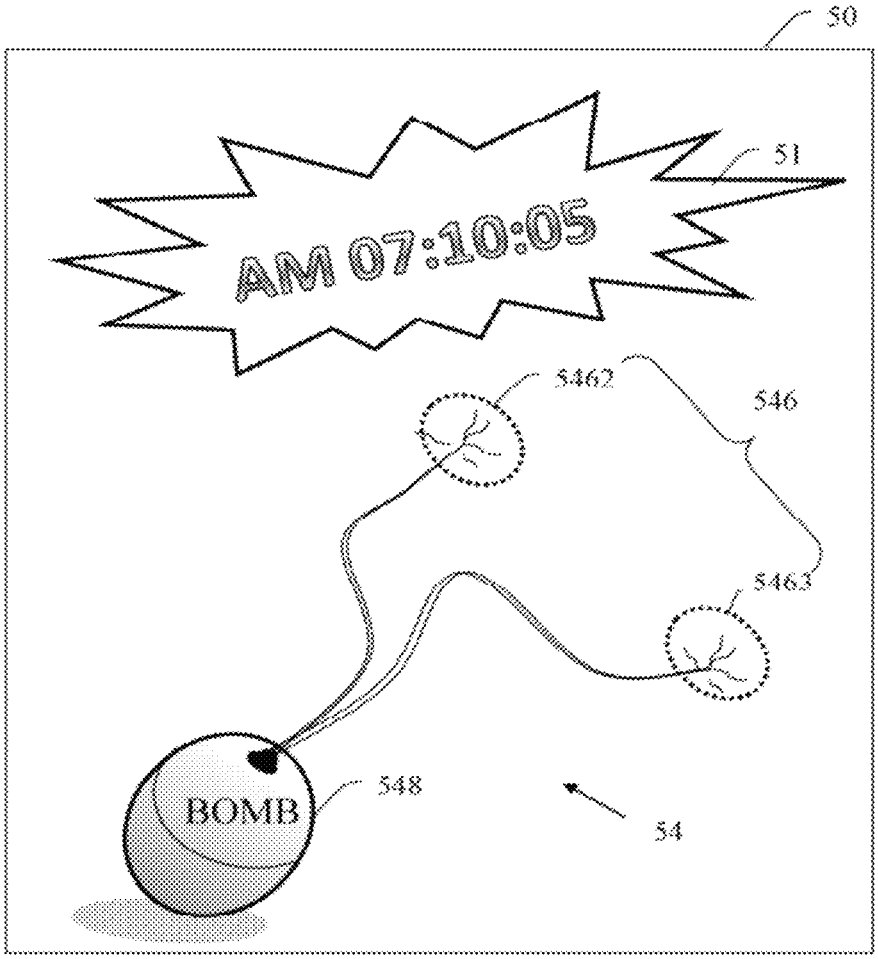
FIG. 3 is a user interface in a user-interface alarm state in other embodiments.

Referring to FIG. 3, in other embodiments, the user interface 50 in the user-interface alarm state may include two contact areas 546. A second animation image 54 may be associated with the two contact areas 546 at the same time. One or more contact actions on each of the contact areas 546 may be detected simultaneity on the touch-screen display 142 to disarm the alarm clock.

Figure 4:
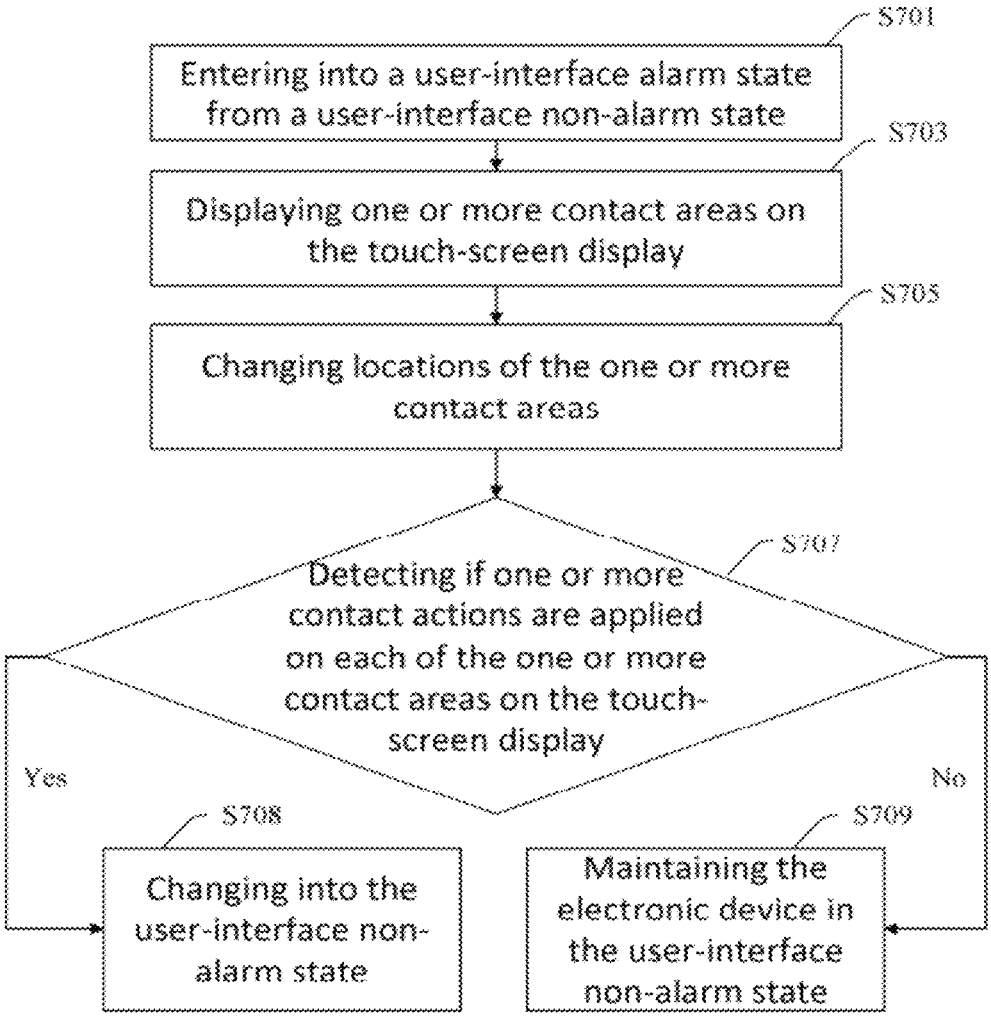
FIG. 4 is a flow chart illustrating a method for providing and disarming an alarm clock in one embodiment.

Referring to FIG. 4, in one embodiment, a computer-implemented method for providing an alarm clock and disarming the alarm clock on an electronic device with a touch-screen display may include the following steps. While the process flow described below includes a number of operations that appear to occur in a specific order, it should be apparent that these processes can include more or fewer operations, which can be executed serially or in parallel (e.g., using parallel processors or other multi-threading environment).

In block S701, entering into a user-interface alarm state from a user-interface non-alarm state in responds to an alarm trigger condition.

In block S703, displaying one or more contact areas on the touch-screen display 142 in the user-interface alarm state.

In block S705, changing locations of the one or more contact areas on the touch-screen display 142.

In block S707, detecting if one or more contact actions are applied on each of the one or more contact areas on the touch-screen display 142.

In block S708, if the last-mentioned determination is made, changing the electronic device 100 into the user-interface non-alarm state.

In block S709, if the last-mentioned determination cannot be made, maintaining the electronic device 100 in the user-interface alarm state.

The method may further include stopping changing locations of the one or more contact areas on the touch-screen display 142 when the one or more contact actions are applied on each of the one or more contact areas; and playing an animation image on the touch-screen display 142 associated with the one or more contact areas.

It is to be understood, however, that even though numerous characteristics and advantages have been set forth in the foregoing description of embodiments, together with details of the structures and functions of the embodiments, the disclosure is illustrative only and changes may be made in detail, especially in matters of shape, size, and arrangement of parts within the principles of the disclosure to the full extent indicated by the broad general meaning of the terms in which the appended claims are expressed.

Depending on the embodiment, certain steps or methods described may be removed, others may be added, and the sequence of steps may be altered. It is also to be understood that the description and the claims drawn for or in relation to a method may include some indication in reference to certain steps. However, any indication used is only to be viewed for identification purposes and not as a suggestion as to an order for the steps.

What is claimed is:

1. A computer-implemented method of providing an alarm clock and disarming the alarm clock on an electronic device with a touch-screen display, comprising:

entering into a user-interface alarm state from a user-interface non-alarm state in responds to an alarm trigger condition;

displaying one or more contact areas on the touch-screen display in the user-interface alarm state;

changing locations of the one or more contact areas on the touch-screen display using an animation defining a two dimensional pathway; subsequently detecting one or more contact actions on each of the one or more contact areas on the touch-screen display; and changing the electronic device into the user-interface non-alarm state.

2. The method of the claim 1, wherein the one or more contact actions comprise one or more press operations on each of the one or more contact areas.

3. The method of the claim 1, wherein the one or more contact actions comprise one or more press operations and a predefined pressing duration of each of the one or more press operations on each of the one or more contact areas.

4. The method of the claim 1, wherein the one or more contact actions comprises one or more substantially circled slide operations around each of the one or more contact areas while maintaining continuous contact with the touch-screen display.

5. The method of the claim 1, wherein changing the locations of the one or more contact areas on the touch-screen display further comprising changing locations of the one or more contact areas on the touch-screen display at a predefined frequency.

6. The method of the claim 1, further comprising playing an animation image on the touch-screen display associated with the one or more contact areas.

7. The method of the claim 1, further comprising stopping changing locations of the one or more contact areas on the touch-screen display when the one or more contact actions are applied on each of the one or more contact areas.

8. The method of the claim 1, wherein the one or more contact areas comprise at least two contact areas, and detecting the one or more contact actions on each of the one or more contact areas on the touch-screen display further comprises detecting one contact action on each of the at least two contact areas simultaneity on the touch-screen display.

9. The method of the claim 1, further comprising playing an alarm audio file at the user-interface alarm state.

10. An electronic device, comprising:

a touch-screen display;

a processor;

a memory; and one or more modules stored in the memory, wherein the one or more modules are adapted to be executed by the processor to:

enter into a user-interface alarm state from a user-interface non-alarm state in responds to an alarm trigger condition;

display one or more contact areas on the touch-screen display in the user-interface alarm state;

change locations of the one or more contact areas on the touch-screen display using an animation defining a two dimensional pathway; subsequently detect one or more contact actions on each of the one or more contact areas on the touch-screen display; and change the electronic device to the user-interface non-alarm state.

11. The electronic device of the claim 10, wherein the one or more contact actions comprise one or more press operations on each of the one or more contact areas.

12. The electronic device of the claim 10, wherein the one or more contact actions comprise one or more press operations and a predefined pressing duration of each of the one or more press operations on each of the one or more contact areas.

13. The electronic device of the claim 10, wherein the one or more contact actions comprise one or more substantially circled slide operations around each of the one or more contact areas while maintaining continuous contact with the touch-screen display.

14. The electronic device of the claim 10, wherein the one or more modules are adapted to change locations of the one or more contact areas on the touch-screen display at a predefined frequency.

15. The electronic device of the claim 10, wherein the one or more modules are adapted to play an animation image on the touch-screen display associated with the one or more contact areas.

16. The electronic device of the claim 10, wherein the one or more modules are adapted to stop changing locations of the one or more contact areas on the touch-screen display when the one or more contact actions are applied on each of the one or more contact areas.

17. The electronic device of the claim 10, wherein the one or more contact areas comprise at least two contact areas, and the one or more modules are further adapted to detect one contact action on each of the at least two contact areas simultaneity on the touch-screen display.

18. The electronic device of the claim 10, wherein the one or more modules are adapted to play an alarm audio file at the user-interface alarm state.

* * * * *